US008695542B2

(12) United States Patent
Vacca et al.

(10) Patent No.: US 8,695,542 B2
(45) Date of Patent: Apr. 15, 2014

(54) MODULE FOR THE COOLING CIRCUIT OF AN ENGINE IN AN AUTOMOBILE

(75) Inventors: Frédéric Vacca, Behoust (FR); Alain Farkh, Montfort-l'Amaury (FR)

(73) Assignee: Valeo Systemes Thermiques, Le Mesnil Saint Denis, Cedex (FR)

( * ) Notice: Subject to any disclaimer, the term of this patent is extended or adjusted under 35 U.S.C. 154(b) by 920 days.

(21) Appl. No.: 12/602,041

(22) PCT Filed: Apr. 23, 2008

(86) PCT No.: PCT/EP2008/054898
§ 371 (c)(1),
(2), (4) Date: May 11, 2010

(87) PCT Pub. No.: WO2008/145461
PCT Pub. Date: Dec. 4, 2008

(65) Prior Publication Data

US 2010/0212612 A1 Aug. 26, 2010

(30) Foreign Application Priority Data

May 25, 2007 (FR) ..... 07 03704

(51) Int. Cl.
*F01P 5/14* (2006.01)

(52) U.S. Cl.
USPC ..... 123/41.15; 123/41.09

(58) Field of Classification Search
USPC ..... 123/41.08–41.09, 41.1, 41.15; 236/12.13–12.23, 34.5, 94, 99 K, 101 A, 236/101 B, 101 C; 251/163, 283, 286, 314, 251/311, 160, 167, 180, 188, 192, 206–209, 251/304, 309
See application file for complete search history.

(56) References Cited

U.S. PATENT DOCUMENTS

| | | | | |
|---|---|---|---|---|
| 3,776,457 | A * | 12/1973 | Cardi | 236/34.5 |
| 4,186,872 | A * | 2/1980 | Bland et al. | 236/34.5 |
| 4,453,668 | A * | 6/1984 | Abel | 236/34.5 |
| 4,883,225 | A * | 11/1989 | Kitchens | 236/34.5 |
| 4,981,260 | A | 1/1991 | Beiser | |
| 5,529,026 | A * | 6/1996 | Kurr et al. | 123/41.1 |
| 6,315,267 | B1 * | 11/2001 | Zajac et al. | 251/69 |
| 6,688,333 | B2 * | 2/2004 | McLane et al. | 137/625.11 |

FOREIGN PATENT DOCUMENTS

| | | |
|---|---|---|
| EP | 1348846 A2 | 10/2003 |
| EP | 1860298 A2 | 11/2007 |
| FR | 2850726 A1 | 8/2004 |

OTHER PUBLICATIONS

English language abstract for FR 2850726 extracted from espacenet.com database, dated Feb. 15, 2010, 32 pages.
PCT International Search Report for PCT/EP2008/054898, dated Aug. 13, 2008, 3 pages.

* cited by examiner

*Primary Examiner* — Hung Q Nguyen
(74) *Attorney, Agent, or Firm* — Howard & Howard Attorneys PLLC

(57) ABSTRACT

A module for a cooling circuit of a motor vehicle engine includes at least one control valve allowing a circulation according to at least one normal mode. The module also includes a thermal safety device capable of allowing a circulation according to another mode called the short-circuit mode in the event of failure of the normal circulation mode.

13 Claims, 5 Drawing Sheets

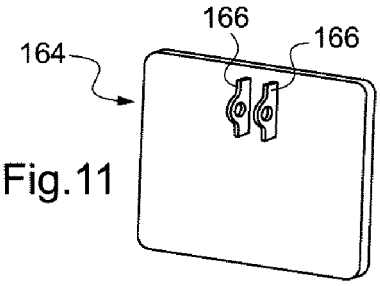
Fig.11
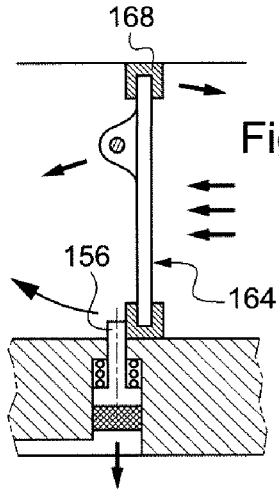
Fig.12
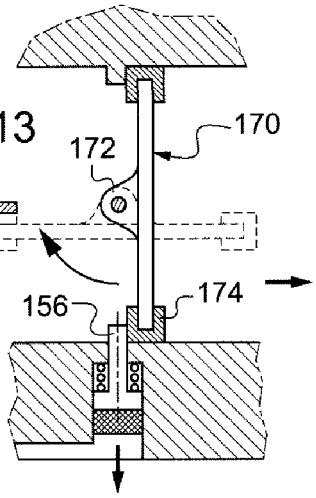
Fig.13
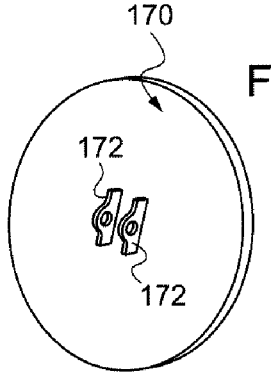
Fig.14
Fig.15A
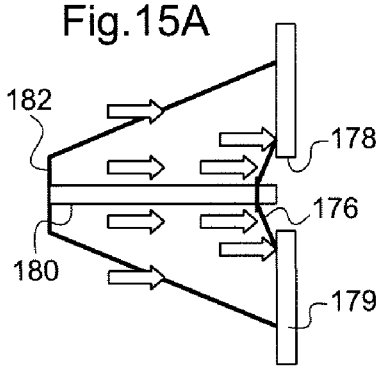
Fig.15B
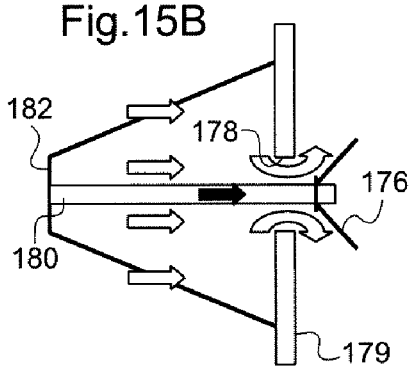

MODULE FOR THE COOLING CIRCUIT OF AN ENGINE IN AN AUTOMOBILE

RELATED APPLICATIONS

This application claims priority to and all the advantages of International Patent Application No. PCT/EP2008/054898, filed on Apr. 23, 2008, which claims priority to French Patent Application No. FR 07/03704, filed on May 25, 2007.

The invention relates to cooling circuits for motor vehicle engines.

More particularly it relates to a module for a cooling circuit of a motor vehicle engine, comprising at least one control valve allowing a circulation according to at least one normal mode.

Usually a cooling circuit of this type is traveled through by a cooling fluid under the action of a pump and it comprises a control valve having an inlet capable of being connected to the engine and a radiator outlet capable of being connected to a cooling radiator (see in particular French patent FR 2 850 726 of 31 Jan. 2003).

In this known cooling circuit, the control valve comprises a rotary adjustment member capable of taking different angular positions in order to control the distribution of the fluid through various outlets which include a radiator outlet capable of being connected to a cooling radiator, a unit heater outlet capable of being connected to a unit heater used to heat the interior of the vehicle, and a diversion outlet capable of being connected to a diversion bypassing the cooling radiator.

Such a control valve is usually controlled by an electric motor which controls the movement of the adjustment member according to a chosen law.

The essential object of the invention is to enhance the safety of such a control valve in the event of a failure of external origin, due, for example, to the vehicle computer or to control electronics, or of internal origin, due, for example, to an electric motor, to a reduction gear or to a hydraulic stage.

Specifically, it is desirable, in such a case, to provide a safety operating mode.

One solution therefore consists in directing the cooling fluid to the cooling radiator to prevent any overheating and damage to the vehicle engine, this engine being able to be a heat engine, an electric motor, or else a hybrid motor.

It is known practice to incorporate a return spring into a valve, in order to return the rotary adjustment member to a safety position in order to ensure the opening of the channel corresponding to the radiator outlet.

However, it is possible to have a failure of the return spring of the valve.

The result of this is that the rotary adjustment member may remain in a position shutting off the radiator outlet. That will have the effect of causing an uncontrolled rise in temperature of the engine and, in time, of causing damage to the latter.

In addition, the addition of a return spring makes it necessary to choose a reduction gear capable of permanently overcoming the force of the spring. This has the effect of overengineering the motor for actuating the valve and of increasing the cost and the space requirement.

The invention is to improve the situation.

Accordingly it proposes a module for a cooling circuit of a motor vehicle engine, comprising at least one control valve allowing a circulation according to at least one normal mode.

According to the invention, said module also comprises a thermal safety device for said circuit, said thermal safety device being capable of allowing a circulation according to another mode called the short-circuit mode in the event of failure of the normal circulation mode.

Therefore, in the event of failure of the normal circulation mode, such as, for example, an accidental overheating that may be due to a failure of the valve, the thermal safety device then allows a circulation according to a short-circuit mode.

This short-circuit mode is designed above all to prevent any risk of overheating of the engine.

Advantageously, the safety device comprising a shutoff means controlled by an element sensitive to the detected temperature of a cooling fluid passing through said cooling circuit, said shutoff means being in a closed position when the detected temperature is below a given threshold and being moved to an open position when the detected temperature exceeds the given threshold, so as to direct at least a portion of the cooling fluid toward a cooling radiator of said cooling circuit while short-circuiting the control valve.

According to another advantageous feature, said thermal safety device comprises an inlet suitable for being connected to an outlet of cooling fluid from the engine, a valve outlet suitable for being connected to the inlet of the control valve and a diversion outlet suitable for being connected to a diversion between the inlet and a radiator outlet of the control valve.

In a first variant embodiment, the thermal safety device is capable of being incorporated into a water outlet casing of the engine, suitable for being mounted on the engine.

The water outlet casing of the engine advantageously comprises a body delimiting a main passageway extending between the valve inlet and the valve outlet and a pipe opening laterally into the main passageway and delimiting a secondary passageway in which the thermal safety device is mounted.

Preferably, the water outlet casing of the engine is suitable for being mounted directly on the engine and for receiving the control valve directly.

In a second variant embodiment, the thermal safety device is capable of being incorporated into a separate equipment item suitable for being mounted between the engine and the control valve.

This separate equipment item advantageously comprises a duct delimiting a main passageway extending between the valve inlet and the valve outlet and a pipe opening laterally into the main passageway and delimiting a secondary passageway in which the thermal safety device is mounted.

In a third variant embodiment, the thermal safety device is incorporated into the control valve.

In this third variant, the control valve advantageously comprises a cylindrical body delimiting a cylindrical housing for an adjustment member mounted so as to rotate about an axis, in which the valve inlet and the valve outlet of the thermal safety device are aligned coaxially with the cylindrical housing and in which the diversion outlet of the thermal safety device is formed by a pipe opening laterally into the cylindrical housing and housing the thermal safety device.

The radiator outlet of the control valve is advantageously formed by a pipe opening laterally into the cylindrical housing of the control valve.

The radiator outlet pipe and the diversion outlet pipe may open in respective locations offset in the axial direction of the control valve.

The radiator outlet pipe and the diversion outlet pipe may also open in respective locations offset in the radial direction of the control valve.

In the latter case, the location of the diversion outlet pipe is preferably outside the zone of action of the adjustment member of the control valve.

In the module of the invention, said shutoff means is preferably a valve element.

The term "valve element" must be understood in the broad sense as designating any shutoff element capable of being placed in the closed position or the open position mentioned above.

In a first exemplary embodiment, the valve element is connected to a thermostatic element capable of moving the valve element from the closed position to the open position when the detected temperature exceeds the given threshold, a retention member being provided to keep the valve element in the open position and prevent it from returning to the closed position.

In a second exemplary embodiment, the valve element comprises a flap mounted so as to pivot about a spindle and kept in the closed position by a retractable stop held in the abutment position by a retention member made of a eutectic material having a melting point corresponding to the given threshold and capable of coming into a retracted position to release the valve element, when the retention member has reached its melting point.

In a third exemplary embodiment, the valve element is connected to an element made of shape-memory alloy, suitable for moving said valve element from the closed position to the open position when the detected temperature exceeds the given threshold.

The element made of shape-memory alloy may, for example, be a stem capable of lengthening, or otherwise of retracting, when the detected temperature exceeds the given threshold.

It may also be a spring, in particular a coil spring, capable of lengthening, or otherwise of retracting, when the detected temperature exceeds the given threshold.

Under another aspect, the invention relates to a cooling circuit of a motor vehicle engine, which comprises a module as defined above.

Other features and advantages of the invention will be better understood on reading the following detailed description with reference to the appended drawings, in which:

FIG. 11 is a view in perspective of a valve element in another embodiment;

FIG. 12 is a partial view in section of a thermal safety device incorporating the valve element of FIG. 11;

FIG. 13 shows, in a partial view in section, a valve body similar to that of FIG. 10 in which the valve element is also made in the form of a pivoting flap;

FIG. 14 is a view in perspective of the valve element of FIG. 13;

FIGS. 15A and 15B represent a valve element connected to an element made of shape-memory alloy, in this instance made in the form of a stem, respectively in the closed position and in the open position;

Figure 1:
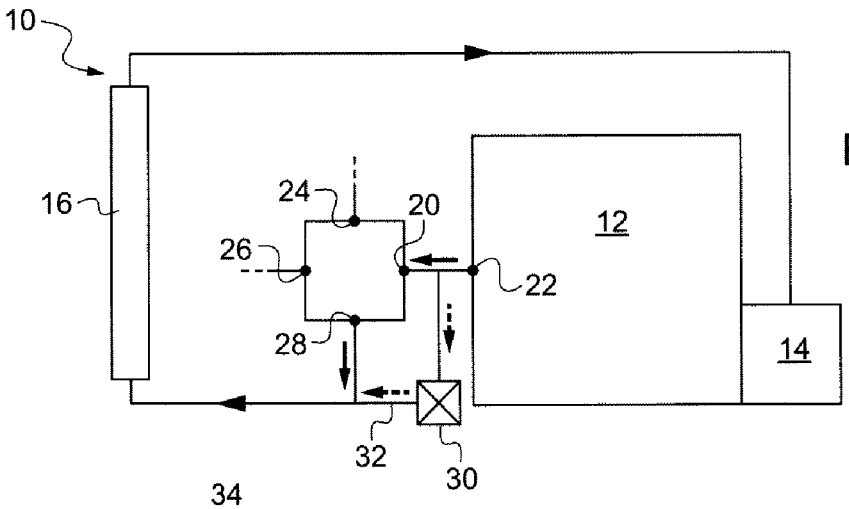
FIG. 1 is a diagram of a cooling circuit for a vehicle engine comprising a module comprising a control valve and a thermal safety device according to the invention.

Reference is made first of all to FIG. 1 which represents a circuit 10 for the cooling of a motor vehicle engine 12, for example a heat engine, an electric motor or a hybrid motor. The circuit 10 is traveled through by a cooling fluid, typically water with added antifreeze, which circulates under the action of a pump 14. The circuit comprises a cooling radiator 16 in which the cooling fluid gives off the heat to a flow of air set in motion by the speed of the vehicle and/or by engine fans (not shown).

The circuit comprises a control valve 18 having an inlet 20 capable of being connected to an outlet 22 of the engine, two other outlets 24 and 26 not described in detail and a radiator outlet 28 capable of being connected to the cooling radiator 16.

The outlets 24 and 26 may be connected, for example, to a unit heater for the heating of the interior and to a diversion duct bypassing the radiator, in a manner known per se.

In a circuit of this type, the control valve 18 may comprise, for example, an adjustment member of the rotary type making it possible to control the distribution of the cooling fluid between the outlets 24, 26 and 28 according to a chosen law, as taught, for example, by the aforementioned French patent. The adjustment member of the control valve is usually controlled by an electric stepper motor or by a reduction gear. The control valve thus allows a circulation according to at least one normal mode.

As mentioned above, in the event of a malfunction of the valve or of its control means, the valve may remain immobilized in a position which does not promote the cooling of the engine.

For reasons of safety, in this case it is necessary to promote the cooling of the engine, therefore to have the cooling fluid pass into the cooling radiator in order to prevent any overheating and hence any damage to the engine.

For this, the invention proposes a module comprising the control valve 18 and a thermal safety device 30 capable of allowing a circulation according to another mode called the short-circuit mode in the event of failure of the normal circulation mode. The thermal safety device 30 is installed on a diversion 32 between the inlet 20 of the valve and the radiator outlet 28 of the valve. The device 30 comprises a shutoff means, in the example a valve element (not shown), which is normally in a closed position, which closes the diversion 32, when the temperature of the cooling fluid, as detected, is below a given threshold (for example 120° C.) In this case, the cooling fluid travels from the outlet 22 of the engine to the inlet 20 of the valve and is then distributed between the channels corresponding to the outlets 24, 26 and 28, as shown by the arrows in solid lines.

In the event of a malfunction resulting in a rise in the temperature, that is to say when the detected temperature exceeds the aforementioned threshold, the valve element of the safety device 30 is automatically, in an irreversible or reversible manner, moved to an open position, which opens the diversion 32. The cooling fluid then passes through the diversion as shown by the arrows in dashed lines. Therefore, at least a portion of the cooling fluid is directed toward the cooling radiator 16 while short-circuiting the control valve 18. Therefore, the thermal safety device 30 is capable of allowing a circulation according to a short-circuit mode in the event of failure of the normal circulation mode.

Figure 2:
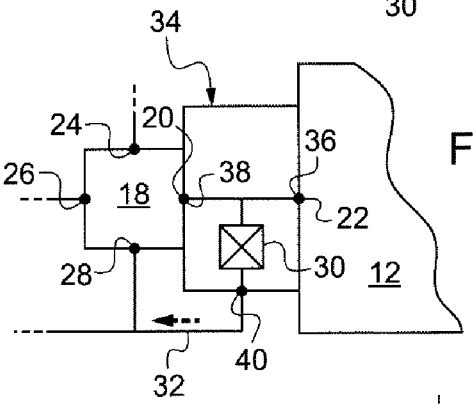
FIGS. 2, 3 and 4 represent respectively three variant embodiments of the module of the invention.

In the variant embodiment of FIG. 2, the thermal safety device 30 is capable of being incorporated into a water outlet casing 34 of the engine, this casing being capable of being mounted on the engine and comprising an inlet 36 capable of being connected to the outlet 22 of the engine, a valve outlet 38 capable of being connected to the inlet 20 of the valve and a diversion outlet 40 capable of being connected to the diversion 32.

Figure 3:
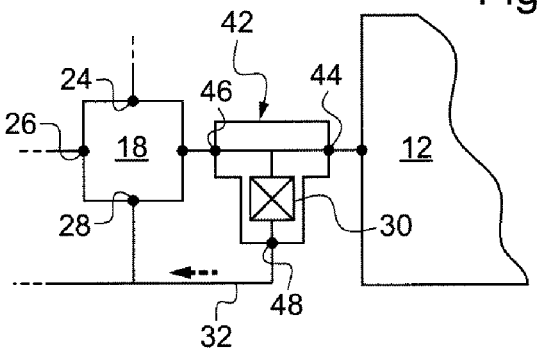

In the variant embodiment of FIG. 3, the thermal safety device 30 is capable of being incorporated into a separate equipment item 42 capable of being mounted between the engine 12 and the control valve 18 and comprising an inlet 44 capable of being connected to the outlet 22 of the engine, a valve outlet 46 capable of being connected to the inlet 20 of the valve and a diversion outlet 48 capable of being connected to the diversion 32.

Figure 4:
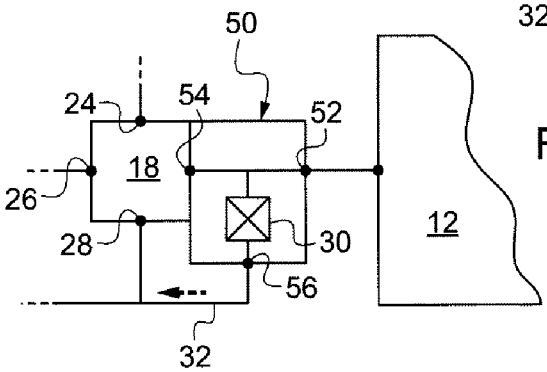

In the variant embodiment of FIG. 4, the thermal safety device 30 is incorporated into the control valve 18 and more particularly into a casing 50 fitted to the control valve and comprising an inlet 52 capable of being connected to the outlet 22 of the engine, a valve outlet 54 connected to the inlet 20 of the valve and a diversion outlet 56 capable of being connected to the diversion 32.

The variants of FIGS. 2, 3 and 4 are functionally equivalent. They differ simply from one another by the method of incorporating the thermal safety device 30 into the module.

Figure 5:
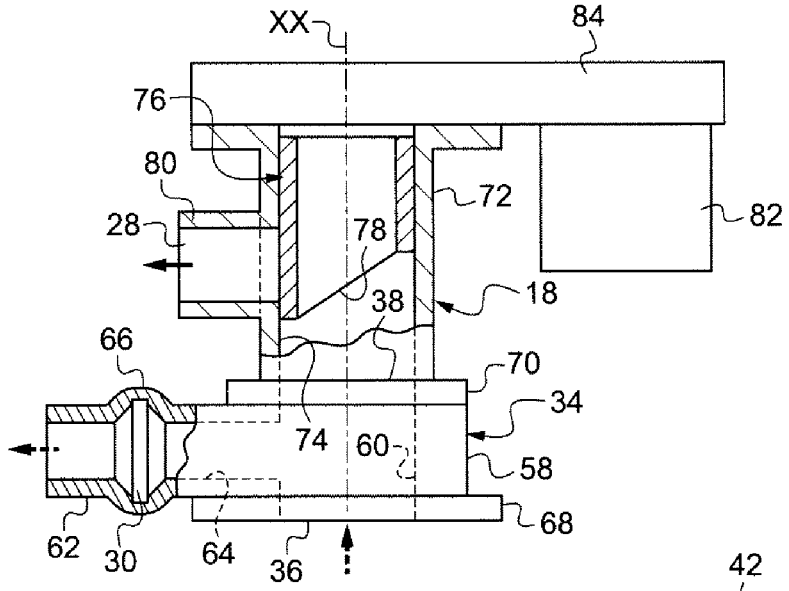
FIG. 5 represents, in a side view and partially in section, an engine water outlet casing incorporating a thermal safety device according to the invention, the water outlet casing being capable of being mounted directly on the engine and of receiving the control valve directly.

Reference is now made to FIG. 5 which represents in greater detail the water outlet casing 34 corresponding to FIG. 2. This casing 34 comprises a body 58 delimiting a main passageway 60 which extends between the valve inlet 36 and the valve outlet 38, and a pipe 62 opening laterally into the main passageway 60 and delimiting a secondary passageway 64 in which the safety device 30 is mounted. The pipe 62 comprises a widened portion 66 for housing the safety device 30. The pipe 62 is advantageously formed in two portions which connect together at this widened portion in order to allow the integration of the safety device 30.

In this embodiment, the water outlet casing 34 is suitable for being mounted directly onto the engine by virtue of a flange 68 and is suitable for receiving the control valve 18 directly by means of a flange 70 of the valve.

As can be seen in FIG. 5, the control valve 18 comprises a cylindrical body 72 delimiting a cylindrical housing 74 with an axis XX in which is rotatably mounted an adjustment member 76 having the shape of a single cylindrical element, for example hollow with a truncated wall 78. Opening laterally into the valve body are several outlet pipes one of which is represented in FIG. 5, namely a pipe 80 which delimits the radiator outlet 28.

The adjustment member 76 may be moved selectively into various angular positions by means of an electric motor 82 such as a reduction gear or a stepper motor which controls the movement of the adjustment member via a reduction mechanism 84. In the event of an operating anomaly, the safety device 30 is moved to an open position and causes the fluid to pass directly through the pipe 62 as shown by the dashed arrow.

Figure 6:
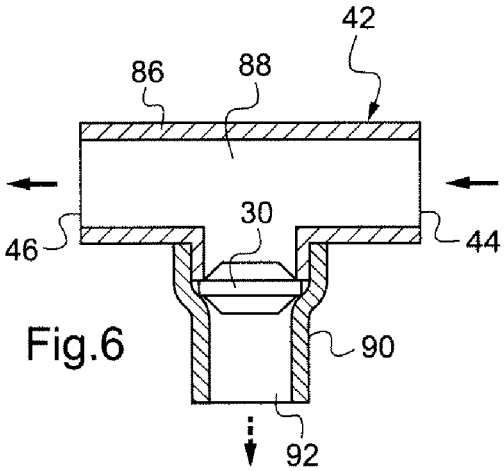
FIG. 6 is a view in section of a separate equipment item into which a thermal safety device according to the invention is incorporated.

Reference is now made to FIG. 6 which illustrates in greater detail the separate equipment item 42 of FIG. 3. This equipment item 42 comprises a duct 86 delimiting a main passageway 88 extending between the valve inlet 44 and the valve outlet 46, and a pipe 90 opening laterally into the main passageway and delimiting a secondary passageway 92 in which the safety device 30 is mounted.

Figure 7:
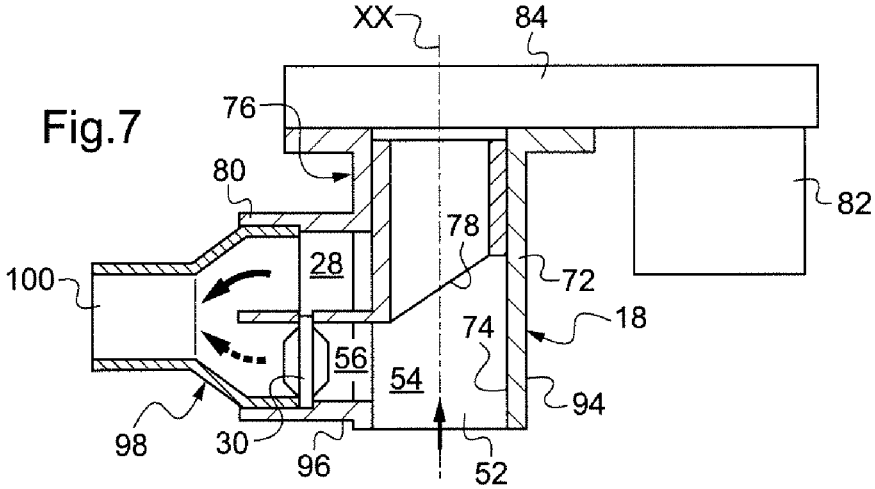
FIG. 7 is a partial view in section of a control valve incorporating a thermal safety device according to the invention.

FIG. 7 illustrates in greater detail the embodiment of FIG. 4. The control valve 18 is substantially similar to that of FIG. 5. It comprises a cylindrical body 72 delimiting a cylindrical housing 74 for the adjustment member 76 mounted so as to rotate about an axis XX. The body 72 of the valve comprises an axial extension 94 to form the valve inlet 52 and the valve outlet 54 of the safety device. The valve inlet 52 and the valve outlet 54 are aligned coaxially with the cylindrical housing 74. The diversion outlet 56 of the safety device is formed by a pipe 96 opening laterally into the cylindrical housing and housing the safety device 30.

As in the case of FIG. 5, the radiator outlet 28 of the control valve is formed by a pipe 80 opening laterally into the cylindrical housing of the control valve. The radiator outlet pipe 80 and the diversion outlet pipe 96 open in respective locations offset in the axial direction of the control valve. The pipes are capped by a manifold 98 which is assembled on the pipes 80 and 96 immobilizing the position of the safety device 30. This manifold 98 comprises an outlet 100 capable of being connected to the radiator.

As a variant, the radiator outlet pipe 80 and the diversion outlet pipe 96 may open in respective locations offset in the radial direction of the control valve.

Figure 8:
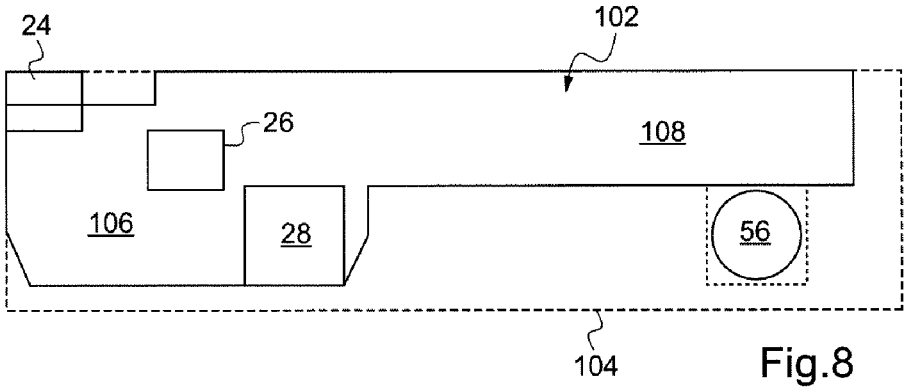
FIG. 8 represents the opening out of the body and of the compression ring of a control valve incorporating a thermal safety device in a variant embodiment.

FIG. 8 shows a compression ring 102 associated with a rotary adjustment member of a control valve in the above-mentioned case. A dashed rectangle represents the opening out 104 of the cylindrical valve body. It can be seen that the radiator outlet 28 of the control valve has a square shape in this instance, while the diversion outlet 56 has a circular shape in this case and that they are offset angularly. This means that the corresponding pipes 80 and 96 (not shown) are offset angularly and not axially as in the case of FIG. 7.

Note that, in all the embodiments proposed by the present invention, the safety device comprises a diversion outlet suitable for being connected to a diversion between the inlet and a radiator outlet of the control valve independent of the radiator outlet of the control valve.

It is also noted that the compression ring 102 comprises a portion 106 of greater width which controls the radiator outlet 28 and the outlet 24 corresponding to the unit heater and to the outlet 26 corresponding to the radiator diversion. The compression ring 102 also comprises a narrower portion 108 which permanently leaves clear the diversion outlet 56. Therefore, this outlet is in a dead zone, which is spared by the compression ring 102, irrespective of the angular position of the adjustment member of the valve. The result of this is that the location of the pipe 96 of the diversion outlet 56 is outside the zone of action of the adjustment member of the control valve.

Various embodiments of the safety device 30, and more particularly of its valve element, will now be described in greater detail.

Figure 9:
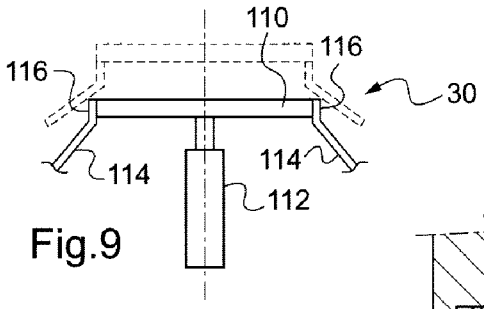
FIG. 9 represents schematically a valve element connected to a thermostatic element.

In the embodiment of FIG. 9, the safety device 30 comprises a valve element 110 made in the form of a plate which is connected to a thermostatic element 112 for example of the expandable wax type capable of moving the valve element from the closed position shown in solid lines to the open position shown in dashed lines. A retention member formed of several elastic tongues 114 is provided to keep the valve element in the open position and prevent it from returning to the closed position. The elastic tongues 116 have respective ends 116 which are separated radially by the valve element 110 in the closed position. When the valve element is moved axially into its open position, the ends 116 of the tongues 114 can move radially inward in order to retain the valve element as shown in dashed lines in FIG. 9. The result of this is that the valve element is kept in the open position in order to promote the cooling of the engine.

Figure 10:
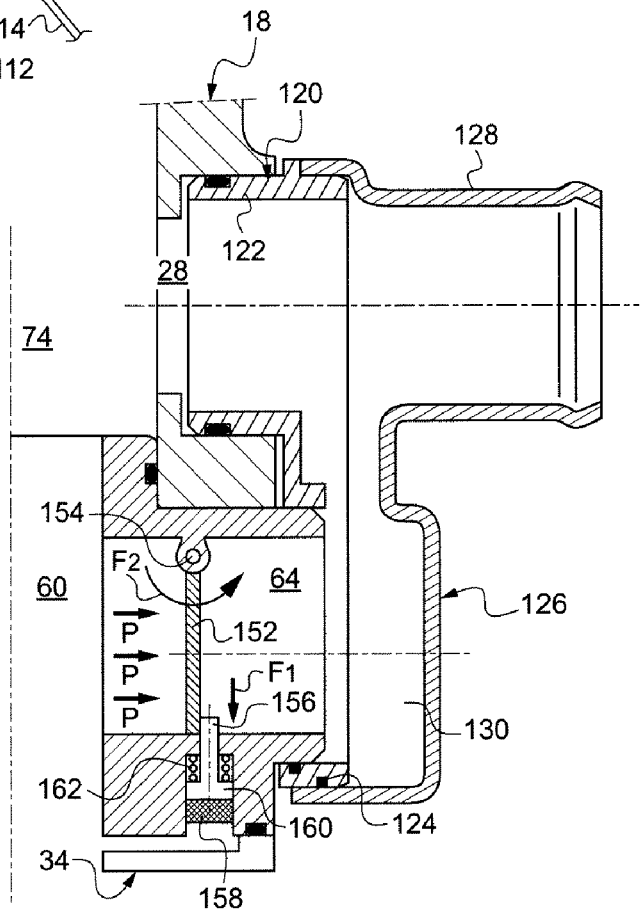
FIG. 10 is a partial view in section of a valve body incorporating a valve element made in the form of a pivoting flap and kept in the closed position by a retention member comprising a eutectic material.

Reference is now made to FIG. 10 which shows a water outlet casing 34 delimiting a main passageway 60 aligned axially with the cylindrical housing 74 of a control valve 18. The water outlet casing 34 also delimits a secondary passageway 64 in which a valve element 152 of the safety device is mounted. Fitted onto the body of the valve is a socket 120 comprising a connection 122 nested into the radiator outlet 28 of the valve and a connection 124 aligned with the secondary passageway 64 of the valve body. Mounted on the socket 120 is a casing 126 forming a pipe 128 suitable for being connected to the cooling radiator and delimiting a chamber 130 suitable for being supplied or not supplied by the cooling fluid depending on whether the valve element 152 is in the open position or in the closed position. This chamber 130 communicates with the inside of the pipe 128.

The valve element 152 of the safety member 30 is made in the form of a flap mounted so as to pivot about a spindle 154 and held in the closed position by a retractable stop 156, which is held in its abutment position by a retention member 158 made of a eutectic material. This retention member is placed against a plate 160 secured to the stop 156, and against which a return coil spring 162 presses.

The principle of operation of the retention member is based on the use of a eutectic material, that is to say of a phase-changing material which can switch from a solid phase to a liquid phase at a very precise temperature depending upon the composition of the material. In other words, this eutectic material has a melting point which corresponds to the given threshold for releasing the valve element when the detected temperature corresponds to this threshold.

In the normal position, the eutectic material 58 is in the solid state and holds the stop 156 in its out position, against the return force applied by the spring 162. The valve element is held against the stop 156 under the effect of the pressure P of the fluid. On the other hand, when the detected temperature exceeds the given threshold, the eutectic material melts and the stop retracts in the direction of the arrow F1, which makes it possible to release the valve element which will pivot about its spindle in the direction of the arrow F2 under the effect of the pressure P of the fluid. The fluid may then reach the radiator by bypassing the control valve.

The valve element 164 shown in FIGS. 11 and 12 is in this instance a pivoting flap of rectangular shape and comprises two flanges 166 for delimiting a spindle for pivoting. The valve element 164 is furnished with a seal 168 on its periphery, as can be seen in FIG. 12.

In the variant embodiment of FIGS. 13 and 14, the valve element 170 is a pivoting flap of generally circular shape furnished with two flanges 172 defining an axis of rotation which extends substantially along the diameter of the flap. Here also, the flap is furnished with two flanges 172 similar to the flanges 166 of FIG. 11. This flap is surrounded by a seal 174. The spindle of the flap is secured to a torsion spring, not shown.

If a eutectic material is used to form a retention member, it is possible to choose very precisely the composition of this material to obtain the chosen melting point.

It is particularly preferable to use tin-bismuth alloys. For example, to obtain a melting point of 130° C., it is possible to choose an alloy containing 40% tin, 56% bismuth and 4% zinc, these percentages being expressed in weight. In such alloys, materials such as cadmium and lead are prohibited in order to prevent any pollution problem.

Reference is now made to FIGS. 15A and 15B which show a valve element 176 made in the form of a flexible seal of the rubber type capable of interacting with an opening 178 arranged in a wall 179. The valve element 176 is mounted at the end of an element 180 made of shape-memory alloy and in this instance having the shape of a stem. The other end of the element 180 rests on a fixed wall 182.

It is known that shape-memory alloys are materials capable of resuming their initially predefined shape triggered by heating, this process being reversible and being able to be repeated several times. As shape-memory alloys that can be used in the invention, it is possible to mention, as an example, nitinol which is a nickel-titanium alloy-based material, copper-aluminum-nickel alloys and copper-aluminum-zinc alloys.

In the example of FIGS. 15A and 15B, the element 180 is capable of elongating when the detected temperature exceeds the given threshold.

Therefore, when the detected temperature is below the given threshold, that is to say below the threshold for triggering the shape-memory alloy, the valve element 176 closes the opening 178 as shown in FIG. 15A. When the detected temperature exceeds the aforementioned trigger threshold, the device is actuated and the element 180 elongates so that the rubber seal passes through the opening 178 and is placed on the other side of the corresponding wall as shown in FIG. 15B. This device offers the advantage of being reversible. Therefore, when the temperature falls below the trigger threshold of the shape-memory alloy, the valve element returns to its normal closed position.

Figure 16A:
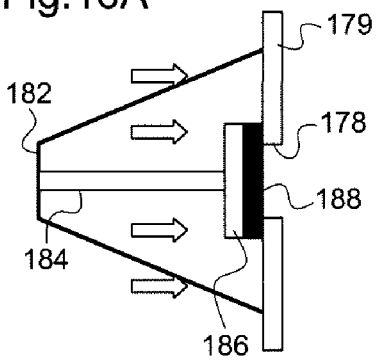
FIGS. 16A and 16B are views similar to FIGS. 15A and 15B in a variant embodiment.
Figure 16B:
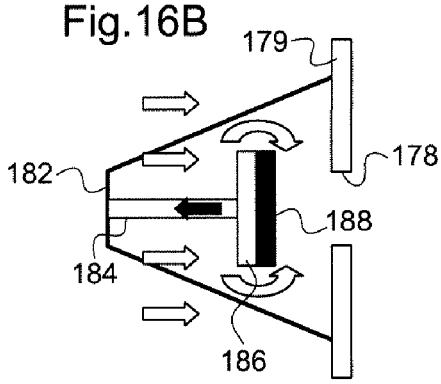

FIGS. 16A and 16B represent a variant in which the shape-memory alloy element 184 is a stem capable of retracting when the detected temperature exceeds the given threshold. In this instance, the valve element 186 is a stopper furnished with a seal 188 capable of pressing against the wall 179 in which the opening 178 is formed.

When the temperature exceeds the given threshold, that is to say the threshold for triggering the shape-memory alloy, the element 184 retracts, which also causes the valve element 186 and the seal 188 to move away from the wall 179 as shown in FIG. 16B. The valve element then moves to the open position.

Figure 17A:
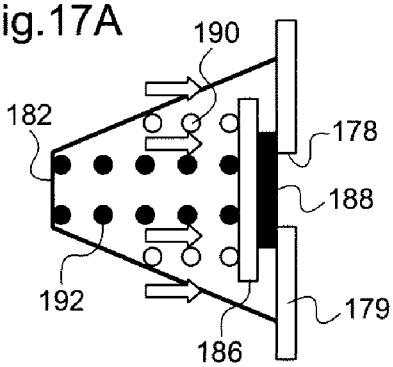
FIGS. 17A and 17B illustrate a valve element connected to an element made of shape-memory alloy, made in this case in the form of a spring, respectively in the closed position and in the open position.
Figure 17B:
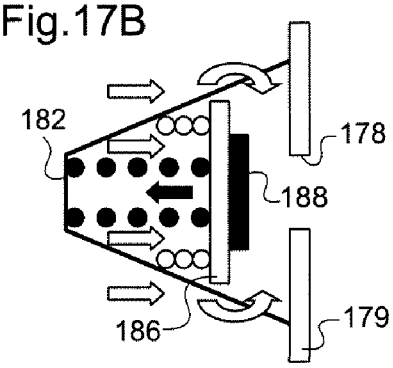

In the embodiment of FIGS. 17A and 17B, the valve element 186 furnished with a seal 188, the presence of which is furthermore not essential, is pressed into the closed position by a pressure spring 190. Furthermore, the valve element 186 is connected to an element 192 made of shape-memory alloy which is produced in the form of a spring, in the example a coil spring, one end of which is attached to the valve element and the other end of which is attached to the bottom wall 182. In the closed position of FIG. 17A, the valve element is pressed against the wall 179 to close the opening 178.

When the detected temperature exceeds the given threshold, that is to say the threshold for triggering the element 192, the latter retracts to clear the opening 178 as can be seen in FIG. 17B.

Figure 18A:
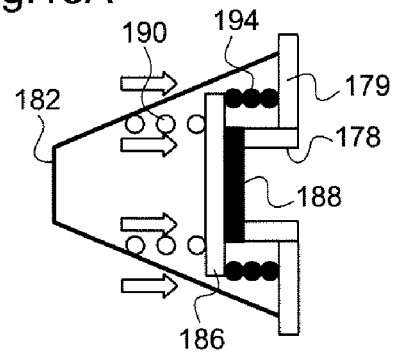
FIGS. 18A and 18B are views similar to FIGS. 17A and 17B in a variant embodiment.
Figure 18B:
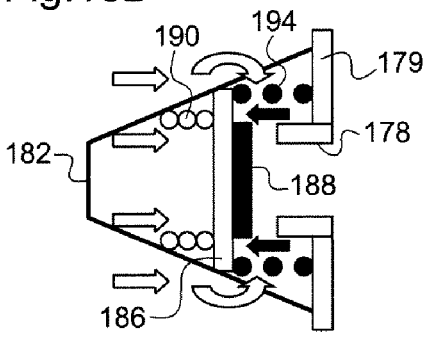

In the embodiment of FIGS. 18A and 18B, the valve element is pressed into its closed position by a coil spring 190 similar to that of FIGS. 17A and 17B. The valve element 186 is connected to an element 194 made of shape-memory alloy produced in the form of a spring, in the example a coil spring, interposed between the wall 179 and the valve element. Unlike the preceding embodiment, the shape-memory element 194 is capable of lengthening when the detected temperature exceeds the given threshold. Therefore, if this threshold is exceeded, the element 194 lengthens which causes the valve element 186 to move in the direction of the opening as can be seen in FIG. 18B.

It is of course possible to conceive of other elements made of shape-memory alloy to control the movement of the valve element in the direction of the opening when the detected temperature exceeds the threshold mentioned above which corresponds to the threshold for triggering the shape-memory alloy used.

The invention finds a particular application in the cooling circuits of motor vehicle engines, in particular heat engines, but also electric motors or hybrid motors.

The invention claimed is:

1. A module for a cooling circuit of a motor vehicle engine, said module comprising at least one control valve (18) allowing a circulation according to at least one normal mode, said control valve (18) includes a cylindrical body (72) delimiting a cylindrical housing (74) for an adjustment member (76) mounted so as to rotate about an axis (XX), said module also comprises a thermal safety device (30) for the cooling circuit, wherein said thermal safety device (30) allows a circulation according to another mode, a short-circuit mode, in the event of failure of the normal mode, and wherein a diversion outlet (56) of said thermal safety device (30) is formed by a pipe (96) opening laterally into said cylindrical housing (74) and housing said thermal safety device (30).

2. The module as claimed in claim 1, wherein said thermal safety device (30) comprises a valve inlet (36; 44; 52) suitable for being connected to an outlet of cooling fluid from the engine, a valve outlet (38; 46; 54) suitable for being connected to an inlet (20) of said control valve (18), and wherein the diversion outlet (40; 48; 56) is suitable for being connected to a diversion (32) between said control valve inlet (20) and a radiator outlet (28) of said control valve (18).

3. The module as claimed in claim 2, wherein said thermal safety device (30) is incorporated into said control valve (18).

4. The module as claimed in claim 3, wherein said valve inlet (52) and valve outlet (54) of said thermal safety device (30) are aligned coaxially with said cylindrical housing (74).

5. The module as claimed in claim 4, wherein said radiator outlet (28) of said control valve (18) is formed by a pipe (80) opening laterally into said cylindrical housing (74) of said control valve (18).

6. The module as claimed in claim 5, wherein said radiator outlet pipe (80) and said diversion outlet pipe (96) open in respective locations offset in the axial direction of said control valve (18).

7. The module as claimed in claim 5, wherein said radiator outlet pipe (80) and said diversion outlet pipe (96) open in respective locations offset in the radial direction of said control valve (18).

8. The module as claimed in claim 7, wherein the location of said diversion outlet pipe (96) is outside a zone of action of said adjustment member (76) of said control valve (18).

9. The module as claimed in claim 1, wherein said thermal safety device (30) comprises a shutoff means (110; 152; 164; 170; 176; 186) controlled by an element sensitive to a detected temperature of a cooling fluid passing through the cooling circuit, said shutoff means (110; 152; 164; 170; 176; 186) being in a closed position when the detected temperature is below a given threshold and being moved to an open position when the detected temperature exceeds the given threshold, so as to direct at least a portion of the cooling fluid toward a cooling radiator (16) of the cooling circuit while short-circuiting said control valve (18).

10. The module as claimed in claim 9, wherein said shutoff means (110; 152; 164; 170; 176; 186) is a valve element.

11. The module as claimed in claim 10, wherein said valve element (110) is connected to a thermostatic element (112) capable of moving said valve element (110) from the closed position to the open position when the detected temperature exceeds the given threshold.

12. The module as claimed in claim 11, wherein a retention member (114) is provided to keep said valve element (110) in the open position and prevent said valve element (110) from returning to the closed position.

13. A cooling circuit of a motor vehicle engine, characterized in that said cooling circuit comprises a module as claimed in claim 1.

* * * * *